United States Patent [19]

Chermin et al.

[11] Patent Number: 4,647,820

[45] Date of Patent: Mar. 3, 1987

[54] DISCHARGE LAMP IGNITION AND SUPPLY CIRCUIT HAVING A PTC RESISTOR

[75] Inventors: Hubertus M. J. Chermin; Jaap Rozenboom, both of Eindhoven, Netherlands

[73] Assignee: U.S. Philips Corporation, New York, N.Y.

[21] Appl. No.: 712,288

[22] Filed: Mar. 15, 1985

[30] Foreign Application Priority Data

Mar. 23, 1984 [NL] Netherlands ..... 8400923

[51] Int. Cl.[4] ..... H05B 37/00

[52] U.S. Cl. ..... 315/245; 315/241 R; 315/244

[58] Field of Search ..... 315/245, 227 R, 232, 315/235, 234, 241 R, 241 P, 241 S, 242, 244

[56] References Cited

U.S. PATENT DOCUMENTS

| | | | |
|---|---|---|---|
| 3,801,867 | 4/1974 | West et al. | 315/341 R |
| 4,135,115 | 1/1979 | Abernethy et al. | 315/245 X |
| 4,181,872 | 1/1980 | Chermin | 315/245 X |
| 4,185,233 | 1/1980 | Riesland et al. | 315/245 X |
| 4,306,177 | 12/1981 | Kaneda | 315/244 |

*Primary Examiner*—Larry Jones

*Attorney, Agent, or Firm*—Robert T. Mayer; Bernard Franzblau

[57] ABSTRACT

In a circuit for an inductively stabilized discharge tube (1) provided with two preheatable electrodes (2, 3) the ends of one electrode (2) are connected via a first capacitor (22) and a second capacitor (24), respectively, to the corresponding ends of the other electrode (3). The second capacitor (24) remote from the supply is shunted by a PTC resistor (23). The discharge tube (1) and inter alia the PTC resistor (23) form part of a lamp unit. The discharge tube (1) ignites readily even at low ambient temperatures. In the lamp operating condition, the influence of the PTC resistor (23) is neglible.

17 Claims, 3 Drawing Figures

DISCHARGE LAMP IGNITION AND SUPPLY CIRCUIT HAVING A PTC RESISTOR

BACKGROUND OF THE INVENTION

This invention relates to an electrical circuit arrangement for igniting and feeding a gas and/or vapour discharge tube provided with two preheatable electrodes. The circuit includes two input terminals adapted to be connected to an alternating voltage supply source. In the connected condition of the discharge tube, one input terminal is connected via at least one inductive stabilization ballast to a first end of one of the preheatable electrodes and the second input terminal is connected to a first end of the second preheatable electrode. The first ends of the two electrodes are interconnected through a first capacitor and the ends of the two electrodes remote from the supply are interconnected through a second capacitor. The invention further relates to a combination of such an electrical circuit arrangement with an interposed DC/AC converter.

A known electrical circuit arrangement of the kind mentioned is described, for example, in Australian Patent No. 138,729. A disadvantage of this known circuit arrangement is that—in order to ensure that the lamp ignites readily at preheated electrodes—the capacitance of the second capacitor, and hence the volume of this second capacitor, should be comparatively large. In fact, the larger will be this capacitance, the larger the electrode preheating current, that is to say the sooner these electrodes will reach the emission temperature and hence the sooner the lamp ignites. A comparatively large second capacitor also has the disadvantage that the freedom of choice of the remaining circuit elements needed for operating the discharge tube is reduced.

SUMMARY OF THE INVENTION

The invention has for an object to provide an electrical circuit arrangement of the kind mentioned in which the capacitance of the second capacitor is comparatively small.

An electrical circuit arrangement according to the invention for igniting and feeding a gas and/or vapour discharge tube provided with two preheatable electrodes, the circuit arrangement having two input terminals intended to be connected to an alternating voltage supply source, while—in the connected condition of the discharge tube—one input terminal is connected via at least one inductive stabilization ballast to a first end of one of the preheatable electrodes and the second input terminal is connected to a first end of the second preheatable electrode, the first ends of the two electrodes being interconnected through a first capacitor and the ends of the two electrodes remote from the supply being interconnected through a second capacitor, is characterized in that the second capacitor is shunted by a resistor having a positive temperature coefficient.

An advantage of this electrical circuit arrangement is that the capacitance of the second capacitor can be comparatively small.

The invention is based on the idea of causing the electrode preheating current first to flow mainly through a circuit element (resistor having a positive temperature coefficient: PTC) shunting the second capacitor. This PTC resistor initially has at its low starting temperature a low ohmic resistance, as a result of which the electrode preheating current can be comparatively large. Upon heating of this PTC resistor by the current flowing through it, its ohmic resistance increases, as a result of which the second capacitor takes over the electrode preheating current for the major part. The now larger influence of the second capacitor moreover leads—due also to the presence of the inductive stabilization ballast—to an alteration of the voltage between the electrodes of the discharge tube.

The function of the first capacitor is inter alia to obtain, together with the second capacitor, a situation close to a resonance condition with the inductive stabilization ballast, as a result of which there is applied across this first capacitor, and hence between the lamp electrodes, an electrical voltage at which the discharge tube can ignite.

The circuit components can be proportioned for this purpose so that (with an admissible neglect of the ohmic resistance of the electrodes) the following formula is approximately satisfied:

$$f = \frac{1}{2\pi\sqrt{L(C_1 + C_2)}}$$

In this formula,

- f represents the frequency (Hz) of the supply source to which the input terminals of the circuit arrangement are connected;
- L represents the self-inductance (Henry) of the inductive stabilization ballast; and
- $C_1$ and $C_2$ represent the capacitances (Farad) of the first and the second capacitors, respectively.

For the actual value of the voltage across the second capacitor—for ignition of the lamp—of course the value of the output voltage of the alternating voltage supply source also should be taken into account.

It should be noted that German "Auslegeschrift" No. 1,914,211 discloses an electrical circuit arrangement for igniting and feeding a gas and/or vapour discharge tube provided with two preheatable electrodes, in which a branch shunting the discharge tube also includes a parallel arrangement of a capacitor and a resistor having a positive temperature coefficient. However, this known circuit arrangement does not include a capacitor interconnecting the first ends of the electrodes. A disadvantage of this known electrical circuit arrangement is that additionally a transformer is included therein.

The following remarks are made as to the introduction of a preferred embodiment of an electrical circuit arrangement according to the invention described below. The discharge tube can be very readily ignited at sufficiently preheated electrodes if—after the electrical circuit arrangement has been switched on—the PTC resistor reaches its change-over point approximately at the same instant as that at which the electrodes have reached their emission temperature. The term change-over point is to be understood to mean that temperature of the PTC resistor at which the latter is at the transition from its low-ohmic range to its high-ohmic range. The relevant preferred embodiment of an electrical circuit arrangement according to the invention is characterized in that the heat capacity M—in Joule/°C.—of the resistor having a positive temperature coefficient satisfies the condition:

$$0.9\left(\frac{N \cdot t_1 \cdot R_{PTC}}{t_2 \cdot R_e}\right) < M < 3\left(\frac{N \cdot t_1 \cdot R_{PTC}}{t_2 \cdot R_e}\right)$$

where N represents the heat capacity (in Joule/°C.) of each of the electrodes; $t_1$ represents the temperature (in °C.) of the electrodes at which the required ignition voltage (in Volts) of the discharge tube is equal to the voltage across the first capacitor; $t_2$ represents the temperature (in °C.) at which the resistor having a positive temperature coefficient is at the transition from its low-ohmic range to its high-ohmic range; $R_{PTC}$ represents the average electrical resistance (in Ω) of the resistor having a positive temperature coefficient in the temperature range of from 0 to $t_2$; and $R_e$ represents the average electrical resistance (in Ω) of each of the electrodes in the temperature range of from 0 to $t_1$.

An advantage of this preferred embodiment is that inter alia the PTC resistor does not prematurely become high-ohmic, that is to say while the electrodes are still too cold. In fact, this would delay further heating of these electrodes. Furthermore, the preferred embodiment avoids the situation in which the ignition of the discharge tube is postponed for a long time also by other causes. This postponement would in fact occur in cases in which the PTC resistor reaches its change-over point only at an instant considerably later than that at which the electrodes have already reached their emission temperature.

In the above formula a starting temperature (ambient temperature) is assumed which is the same for both components, i.e. the PTC resistor and the electrodes, in this case 0° C. The underlying consideration is that it is generally difficult to cause a discharge tube to ignite at comparatively low ambient temperatures. This is due, inter alia, to the fact that in this case—without further steps being taken—the electrodes, after an initial preheating, can cool rapidly again, as a result of which an ignition of the discharge tube is delayed or even may be prevented entirely.

With the said preferred embodiment, this disadvantage is reduced. It should be noted that the invention is also intended for use in electrical circuit arrangements which are to be used in the open air, and which consequently have to be able to ignite the discharge tube even when it freezes.

The PTC resistor could be held in its high-ohmic range during the operating condition of the discharge tube by causing an electrical current to flow through this PTC resistor.

In a next preferred embodiment of an electrical circuit arrangement according to the invention, the resistor having a positive temperature coefficient forms, together with the discharge tube, a part of a lamp unit.

An advantage of this preferred embodiment is that the PTC resistor is then generally also heated by the discharge tube, this heat serving to maintain the PTC resistor in its high-ohmic range. As a result, the current flowing through the PTC resistor can be comparatively small in the operating condition of the discharge tube. This results in only small electrical losses in the PTC resistor and thus leads to a higher system efficiency of the circuit arrangement.

The invention further relates to a combination of the last-mentioned preferred embodiment of an electrical circuit arrangement according to the invention with a DC/AC converter having an output frequency of at least 1 kHz, the input terminals of the electrical circuit arrangement being connected to output terminals of the converter and the electrical circuit arrangement forming part of the lamp unit.

An advantage of this combination is that the inductive stabilization ballast and the two capacitors provided in the circuit discharge tube can be comparatively small. This means that these circuit elements may also form more readily part of the lamp unit.

BRIEF DESCRIPTION OF THE DRAWING

An embodiment of the invention will now be described more fully with reference to the accompanying drawings in which.

DESCRIPTION OF THE PREFERRED EMBODIMENTS

Figure 1:
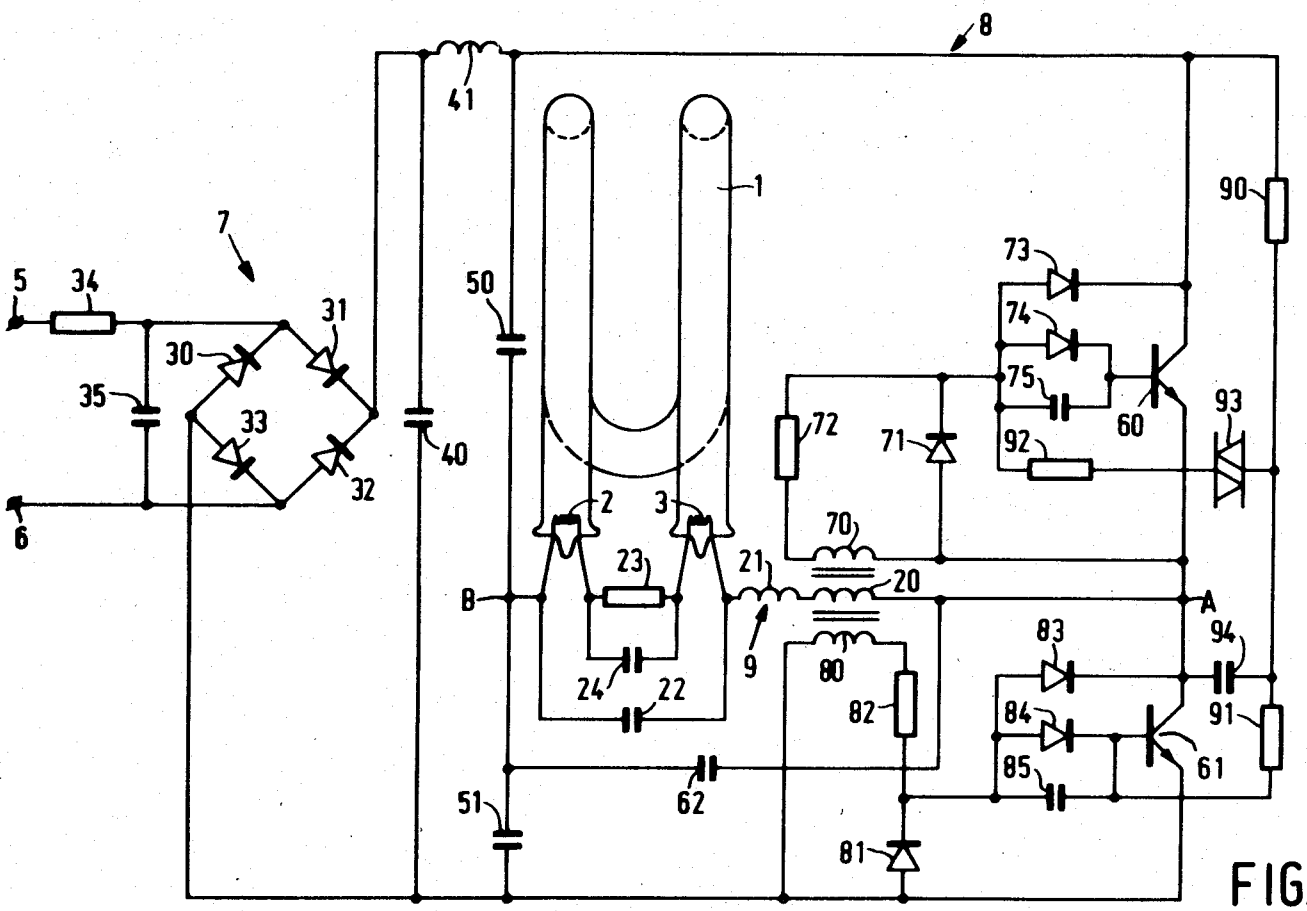
FIG. 1 shows an electrical circuit arrangement according to the invention and a discharge tube connected thereto. A supply circuit for this electrical circuit arrangement comprising a DC/AC converter is further shown.

Referring now to FIG. 1, reference numeral 1 designates a low-pressure mercury vapour discharge tube of about 18 W. This discharge tube has the form of a hook (cf. also FIG. 3). The discharge tube 1 is provided with two preheatable electrodes 2 and 3.

Reference numerals 5 and 6 denote input terminals intended to be connected to an electrical supply source of about 220 V, 50 Hz.

The discharge tube 1 is ignited and fed via an AC/DC converter 7 connected to the terminals 5 and 6 and a succeeding DC/AC converter 8. Reference numeral 9 designates an electrical circuit arrangement according to the invention. This electrical circuit arrangement 9 is provided with two input terminals A and B. These terminals A and B at the same time represent the output terminals of the DC/AC converter 8. Arrangement 9 forms a branch of said DC/AC converter 8.

The electrical circuit arrangement 9 according to the invention will first be disclosed. Subsequently, the two converters (7 and 8) will be described.

The terminal A is connected via a series arrangement of a primary winding 20 of a current transformer and an inductive stabilization ballast 21 to a first end of the preheatable electrode 3 of the discharge tube 1. The terminal B is connected to a first end of the preheatable electrode 2 of the discharge tube 1. The first ends of the two electrodes 2 and 3 are interconnected through a first capacitor 22. The ends of the two electrodes 2 and 3 remote from the supply are interconnected through a parallel arrangement of a resistor 23 having a positive temperature coefficient (PTC) and a second capacitor 24.

The AC/DC converter 7 is provided with a bridge comprising four diodes 30 to 33 inclusive.

The input terminal 5 is connected via a resistor 34 to a first input terminal of the diode bridge. The terminal 6 is connected to a second input terminal of this diode bridge. The two input terminals of the diode bridge are interconnected through a capacitor 35. The combination of the resistor 34 and the capacitor 35 forms an input filter.

Two output terminals of the diode bridge are interconnected through a smoothing capacitor 40. A smoothing coil 41 is connected to this capacitor.

The DC/AC converter 8 is connected to the ends of the combination of the capacitor 40 and the coil 41. The converter 8 is constructed as a half-bridge converter. The first pair of limbs of this half-bridge converter is constituted by a series arrangement of two branches each comprising a capacitor, 50 and 51 respectively. A second pair of limbs of this half-bridge converter is constituted by a series arrangement of two branches each comprising an npn transistor, 60 and 61 respectively. An intermediate branch of the half-bridge converter is constituted by a connection between the junction A between the two transistors 60 and 61 and the junction B situated between the two capacitors 50 and 51. This connection is formed by the electrical circuit arrangement 9 according to the invention. The junctions A and B are further interconnected through a capacitor 62.

The part of the circuit arrangement of FIG. 1 still to be described relates to a control circuit for the transistors 60 and 61 of the DC/AC converter 8, constructed as a half-bridge converter, and to a starting circuit for this converter.

The control circuit of the transistor 60 is fed via a secondary winding 70 of the current transformer. A series arrangement of a diode 71 and a resistor 72 is connected to this winding 70. A junction between the winding 70 and the diode 71 is connected to the junction A. A junction between the diode 71 and the resistor 72 is connected via a diode 73 to the collector of the transistor 60. Furthermore, this junction between the diode 71 and the resistor 72 is connected via a parallel arrangement of a diode 74 and a capacitor 75 to the base of the transistor 60.

A series arrangement of a diode 81 and a resistor 82 is connected to a second secondary winding 80 of the current transformer. The anode side of the diode 81 is connected to the smoothing capacitor 40.

In a similar manner as in the control circuit of the transistor 60, in the control circuit of the transistor 61 a junction between the diode 81 and the resistor 82 is connected via a diode 83 to the collector of the transistor 61. Furthermore, this junction between the diode 81 and the resistor 82 is connected via a parallel arrangement of a diode 84 and a capacitor 85 to the base of the transistor 61.

Moreover, provision is made of a series arrangement of a resistor 90 and a resistor 91 connecting the collector of the transistor 60 to the base of the transistor 61.

A junction between the diode 71 and the resistor 72 is connected via a series arrangement of a resistor 92 and a bidirectional threshold device (diac) 93 to a junction between the resistors 90 and 91. Finally, the junction between the resistors 90 and 91 is connected via a capacitor 94 to the junction A. The circuit elements 90 to 94 inclusive constitute the starting circuit of the DC/AC converter 8.

The circuit arrangement of FIG. 1 described operates as follows. If the terminals 5 and 6 are connected to the supply source of about 220 V, 50 Hz, the capacitor 40 will be charged via the diode bridge 30 to 33 inclusive. Via the coil 41, the capacitors 50 and 51 also will be charged. At the same time, the starting capacitor 94 will be charged, i.e. via the circuit 41, 90 94 and inter alia A, B. When the voltage at the starting capacitor 94 then reaches the threshold voltage of the circuit element 93, the circuit element 93 will become conductive and make the transistor 60 conduct via the circuit elements 92 and 74/75.

This results in a current flow via the capacitor 50, the transistor 60, the junction A, the circuit elements 20, 21, 3, 23, 2 to the junction B. This current preheats the electrodes 2 and 3 of the discharge tube 1. The PTC resistor 23 is then in fact still comparatively cold, that is to say it is in its low-ohmic range.

Via the current transformer 20, 70, 80, and the control circuits of the two transistors the said current between A and B now leads to the transistor 60 becoming non-conducting and the transistor 61 becoming conducting. This results in the direction of the current in the circuit A-B being reversed. This other current direction in turn ensures that—via the current transformer—the transistor 61 becomes non-conducting and the transistor 60 becomes conducting. This process is continuously repeated. The alternating voltage then flowing in the circuit A-B causes the lamp electrodes 2 and 3 to be further preheated. Of course, the PTC resistor 23 itself will then also assume a higher temperature due to the current flowing through it. The heat capacity of this PTC resistor 23 is chosen so that it reaches its change-over point between the low-ohmic range and the high-ohmic range at the instant at which the two electrodes 2 and 3 have just reached their emission temperature. This will be further described later. When the resistor 23 is high-ohmic, the overall capacitance of the capacitors 22 and 24 is sufficient to obtain—via a series resonance condition with the coil 21—a voltage between the electrodes 2 and 3 which is sufficient to cause the discharge tube 1 to ignite.

Since the PTC resistor 23 and the discharge tube 1 form part of a lamp unit (cf. FIG. 3), this PTC resistor is kept during operation of the discharge tube at such a high temperature mainly produced by the heat in the tube that the high-ohmic condition is maintained.

In an embodiment, the circuit elements had the following approximate values:

capacitor 22: 2.2 nF
capacitor 24: 1.8 nF
capacitor 35: 33 nF
capacitor 40: 11 μF
capacitor 50: 220 nF
capacitor 51: 220 nF
capacitor 62: 910 pF
capacitor 75: 270 nF
capacitor 85: 270 nF
capacitor 94: 22 nF
coil 21: 3 mH
coil 41: 1.5 mH
transformation ratio of the transformer (winding 20, 70, 80)=1:1:1;
resistor 34: 4.7Ω
resistor 72: 39Ω
resistor 82: 39Ω
resistor 90: 680 kΩ
resistor 91: 680 kΩ
resistor 92: 47Ω.

The threshold voltage of the circuit element 93 is about 32 V.

The heat capacity M of the PTC resistor 23 is about 250 milliJoule/°C.

The heat capacity N of each of the electrodes is about 2.5 milliJoule/°C.

$t_1=850°$ C. (i.e. the temperature of the electrodes at which the required ignition voltage (in volts) of the discharge tube 1 is equal to the voltage (in volts) across the first capacitor (22)).

$t_2=115°$ C. (i.e. the transition temperature at which the PTC resistor changes from its low-ohmic range to its high-ohmic range).

$R_{PTC}=450\Omega$ (i.e. the average electrical resistance of the resistor having a positive temperature coefficient in the temperature range from 0 to $t_2$).

$R_e=40\Omega$ (i.e. the average electrical resistance of each of the electrodes in the temperature range from 0 to $t_1$).

In this example, the condition is satisfied:

$$0.9\left(\frac{N\cdot t_1\cdot R_{PTC}}{t_2\cdot R_e}\right) < M < 3\left(\frac{N\cdot t_1\cdot R_{PTC}}{t_2\cdot R_e}\right)$$

In fact: 187 mJ/°C.<250 mJ/°C.<624 mJ/°C.

In this embodiment, the discharge tube 1 ignited at a voltage of about 600 V between the electrodes 2 and 3. In the operating condition, the frequency of the electrical current through the discharge tube 1 is about 28 kHz.

In a variation of the circuit described, the control transformer (20,70,80) may be brought periodically into saturation.

Figure 2:
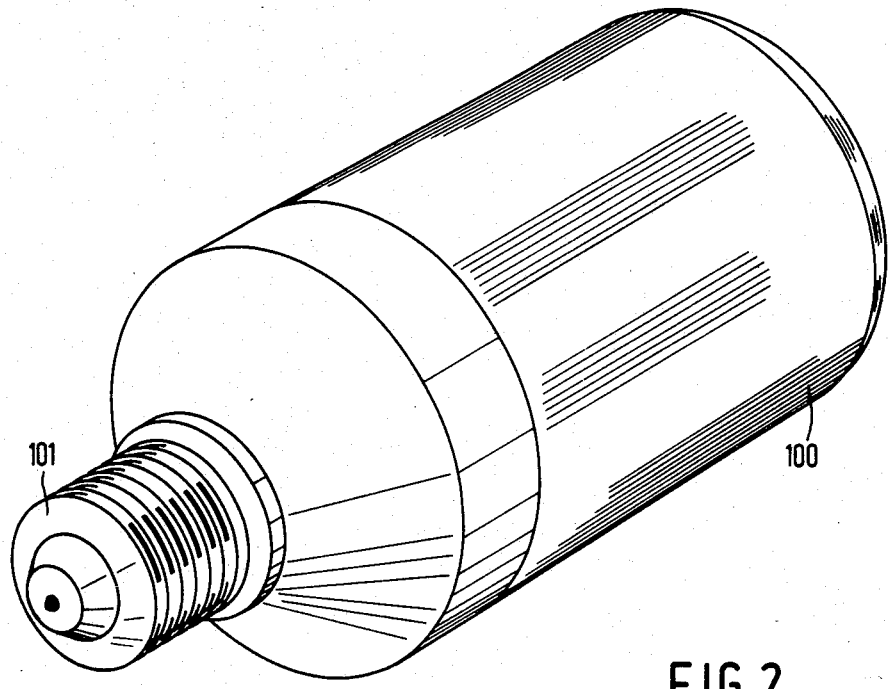
FIG. 2 is a perspective view of a lamp unit provided with an electrical circuit arrangement of the kind shown in FIG. 1.

In FIG. 2, reference numeral 100 designates an outer bulb of the lamp unit. Reference numeral 101 denotes a lamp cap. This lamp unit can be exchanged for an incandescent lamp.

Figure 3:
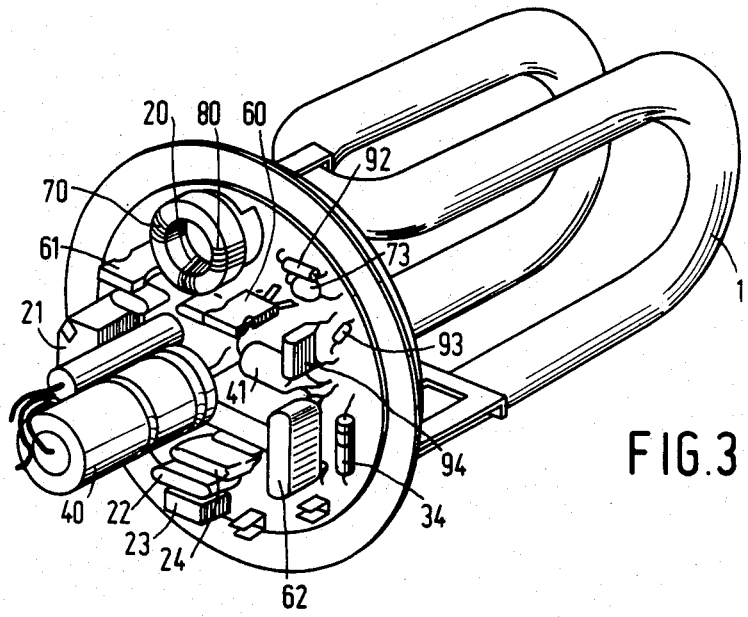
FIG. 3 is a perspective view of the same lamp unit as shown in FIG. 2, but without an envelope of the discharge tube and without an envelope of the cap of the lamp unit.

In FIG. 3, corresponding reference numerals—as used in FIG. 1—relate to the same components.

The lamp unit described ignites within one second with sufficiently preheated electrodes. This also holds for ignition at ambient temperatures in the proximity of 0° C. The system efficiency of this lamp unit is about 60 lumen/W.

What is claimed is:

1. An electrical circuit arrangement for igniting and feeding a discharge tube provided with two preheatable electrodes comprising: two input terminals adapted to be connected to an alternating voltage supply source, and in the connected condition of the discharge tube, one input terminal is connected via at least one inductive stabilization ballast to a first end of one of the preheatable electrodes and the second input terminal is connected to a first end of the second preheatable electrode, the first ends of the two electrodes being interconnected through a first capacitor and the ends of the two electrodes remote from the supply being interconnected through a second capacitor, and a resistor having a positive temperature coefficient connected in shunt with the second capacitor.

2. An electrical circuit arrangement as claimed in claim 1, characterized in that the heat capacity M—in Joule/°C.—of the resistor having a positive temperature coefficient satisfies the condition:

$$0.9\left(\frac{N\cdot t_1\cdot R_{PTC}}{t_2\cdot R_e}\right) < M < 3\left(\frac{N\cdot t_1\cdot R_{PTC}}{t_2\cdot R_e}\right)$$

where N represents the heat capacity (in Joule/°C.) of each of the electrodes;

$t_1$ represents the temperature (in °C.) of the electrodes at which the required ignition voltage (in volts) of the discharge tube is equal to the voltage (in volts) across the first capacitor;

$t_2$ represents the transition temperature (in °C.) at which the resistor having a positive temperature coefficient changes from its low-ohmic range to its high-ohmic range;

$R_{PTC}$ represents the average electrical resistance (in Ω) of the resistor having a positive temperature coefficient in the temperature range from 0 to $t_2$;

and $R_e$ represents the average electrical resistance (in Ω) of each of the electrodes in the temperature range from 0 to $t_1$.

3. An electrical circuit arrangement as claimed in claim 2 wherein the positive temperature coefficient resistor and the discharge tube together form a part of a lamp unit.

4. An electrical circuit arrangement as claimed in claim 1 wherein the resistor having a positive temperature coefficient forms, together with the discharge tube a part of a lamp unit.

5. A combination of an electrical circuit arrangement as claimed in claim 4 with a DC/AC converter having an output frequency of at least 1 kHz, characterized in that the input terminals of the electrical circuit arrangement are connected to output terminals of the converter and the electrical circuit arrangement forms part of the lamp unit.

6. A circuit for starting and operating a discharge tube having first and second preheatable electrodes comprising:

a pair of input terminals for connection to a source of high frequency AC voltage, a ballast inductor, a PTC resistor and first and second capacitors, means for connecting the ballast inductor, the first and second preheatable electrodes and the PTC resistor in a first series circuit between said input terminals when the discharge tube is connected to the circuit, means connecting the first capacitor in parallel with a part of the series circuit that includes at least the first and second tube electrodes, and means connecting the second capacitor in parallel with the PTC resistor.

7. A circuit as claimed in claim 6 wherein the PTC resistor is connected in said first series circuit between the first and second preheatable electrodes so that the first capacitor shunts the series connection of the first and second electrodes and the PTC resistor.

8. A circuit as claimed in claim 7 wherein the PTC resistor provides a current path for a major part of a preheat current that flows through the tube electrodes from the input terminals prior to ignition of the tube, said PTC resistor being chosen to have a heat capacity characteristic relative to that of the tube electrodes such that, after an initial energization of the circuit, the PTC resistor changes over from its low resistance state to its high resistance state at approximately the same time that the preheatable electrodes achieve their emission temperature.

9. A circuit as claimed in claim 7 wherein the first and second capacitors and the ballast inductor together form a series resonant circuit prior to ignition of an electric discharge in the tube such that a voltage is developed across the first capacitor, and hence across the tube electrodes, of a magnitude sufficient to cause the discharge tube to ignite after a time period sufficient to heat the electrodes to their emission temperature.

10. A circuit as claimed in claim 6 wherein the first capacitor is connected in parallel with the discharge tube and in series with the ballast inductor.

11. A circuit as claimed in claim 10 wherein the first and second capacitors and the ballast inductor together form a circuit that will operate close to a resonance condition such that an ignition voltage for the discharge tube will be developed across the first capacitor during an initial start-up phase thereby to promote ignition of the tube.

12. A circuit as claimed in claim 6 wherein the PTC resistor is located in thermal coupling relationship to the discharge tube so that in the operating condition of the tube heat developed in the tube helps to keep the PTC resistor in its high resistance state.

13. A circuit as claimed in claim 6 wherein the PTC resistor is chosen to have a heat capacity characteristic relative to that of the tube electrodes such that, after an initial energization of the circuit, the PTC resistor changes over from its low resistance state to its high resistance state at approximately the same time that the preheatable electrodes achieve their emission temperature.

14. A circuit as claimed in claim 6 wherein the PTC resistor has a heat capacity M in Joule/°C. that satisfies the relation:

$$0.9\left(\frac{Nt_1 \cdot R_{ptc}}{t_2 \cdot R_e}\right) < M < 3\left(\frac{Nt_1 \cdot R_{ptc}}{t_2 \cdot R_e}\right)$$

where N, $t_1$, $t_2$, $R_{ptc}$ and $R_e$ are defined in the specification.

15. A circuit as claimed in claim 6 wherein said source of high frequency AC voltage comprises a D/AC converter having input terminals coupled to a source of DC supply voltage and output terminals connected to said pair of input terminals of the circuit.

16. A circuit as claimed in claim 15 wherein said DC/AC converter comprises, first and second transistors connected in series across the converter input terminals, and a current transformer having a primary winding connected in series with said series circuit including the ballast inductor, the first and second electrodes and the PTC resistor, said current transformer having first and second secondary windings coupled to base electrodes of the first and second transistors, respectively, via first and second respective parallel circuits each including a diode and a capacitor.

17. A circuit as claimed in claim 16 wherein said DC/AC converter further comprises a start-up circuit comprising:

first and second resistors connected in series between one input terminal of the converter and the base electrode of one of the transistors, a third capacitor connected between a junction point of said resistors and a collector electrode of said one transistor, and a voltage-threshold element coupled between said junction point and the base electrode of the other one of said transistors via the respective parallel circuit of a diode and capacitor.

* * * * *